United States Patent [19]

Marshall et al.

[11] 4,439,156

[45] Mar. 27, 1984

[54] ANTI-ARMOR WEAPONS TRAINER

[75] Inventors: Albert H. Marshall, Orlando; Herbert C. Towle, Maitland; Gary M. Bond, Orlando; Bon F. Shaw, Winter Park, all of Fla.

[73] Assignee: The United States of America as represented by the Secretary of the Navy, Washington, D.C.

[21] Appl. No.: 338,696

[22] Filed: Jan. 11, 1982

[51] Int. Cl.[3] ..... F41G 3/00

[52] U.S. Cl. ..... 434/12; 434/20; 434/22; 273/312

[58] Field of Search ..... 434/11, 12, 14, 16–22; 273/359, 366–371, 378, 406, 407, 312

[56] References Cited

U.S. PATENT DOCUMENTS

| | | | |
|---|---|---|---|
| 2,674,923 | 4/1954 | Brandt | 434/12 |
| 3,798,796 | 3/1974 | Stauff et al. | 434/20 |
| 3,832,791 | 9/1974 | Robertson | 434/22 |
| 4,065,860 | 1/1978 | Linton et al. | 434/22 |
| 4,245,403 | 1/1981 | Hipp | 434/11 |
| 4,290,757 | 9/1981 | Marshall et al. | 434/12 |
| 4,321,043 | 3/1982 | Grimmer et al. | 434/18 |
| 4,340,370 | 7/1982 | Marshall et al. | 434/22 |

FOREIGN PATENT DOCUMENTS

| | | | |
|---|---|---|---|
| 2631000 | 1/1977 | Fed. Rep. of Germany | 434/19 |

*Primary Examiner*—Richard C. Pinkham
*Assistant Examiner*—Leo P. Picard
*Attorney, Agent, or Firm*—Robert F. Beers; Robert W. Adams; Robert J. Veal

[57] ABSTRACT

A training device for simulated anti-armor weapons system utilizes a microprocessor system to perform a number of functions including solving dynamic flight equations of a simulated missile and determining the gunner's aiming error. A miniature terrain board having a miniature target with an infrared source provides the aim point for a gunner using a simulated weapon launcher. An infrared sensing device mounted in the weapon provides input to the microprocessor while a CCTV provides an instructor with a gunner's view. Sound, visibility, and recoil associated with weapons use are simulated by peripheral devices under the control of the microprocessor. The gunner's aiming error and view are displayed in real time on an instructor's console which provides for instructor input and recording of gunner performance.

13 Claims, 10 Drawing Figures

ANTI-ARMOR WEAPONS TRAINER

FIELD OF THE INVENTION

This invention relates to military training devices and in particular to weapons training devices. More particularly, this invention relates to anti-armor training devices wherein the weapon is of a type used by combat infantry troops. In greater particularity, the present invention relates to a weapons trainer having a simulated armored target moving about on a simulated terrain, wherein the operator of said weapon engages the target with a simulated missile. The invention may be more particularly described as a simulated anti-armor weapons system utilizing computer generated missiles to engage simulated targets.

BACKGROUND OF THE INVENTION

Modern weapons systems involve expensive and complex technology, thus improving the weapon capability at the expense of operator training, which would be cost prohibitive using live weapons and full scale targets. Numerous training systems have been developed in an attempt to effectively and efficiently provide hands-on experience to weapons operators. A number of such systems employ laser or collimated light beams to simulate the projectile. Such systems must ignore or approximate factors such as lead, drop, drag, and flight time since the light beam does not approximate the trajectory or other flight characteristics of a projectile.

Many training devices employ screens on which targets are presented or distantly located targets, with various means of determining the operator's accuracy. Screen training devices do not require much space, but they may not provide satisfactory optical resolution. Displaced targets require large areas of training space.

SUMMARY OF THE INVENTION

The present invention employs a microprocessor computer to solve the flight equations of a missile launched from a weapon such as the military DRAGON, TOW, or VIPER systems. The missile simulated by the solved flight equations is under the control of the weapon's gunner and traverses the simulated distance to the target in real time. The actual distance to the target is less than 30 feet and the target is a miniature armored vehicle, moved through a selected engagement scenario by a stepper motor, on a miniature terrain board. The target has an infrared source located at its center of mass, said source being sensed by a photodiode matrix array located in a simulated weapon which transfers data to the microprocessor computer, wherein the data is used to determine gunner aiming error. The target location is also controlled by the microprocessor. The location of the target is also input to the flight equations. The microprocessor also controls a number of subsystems used to simulate actual weapon conditions, including a sound generator subsystem simulating launch, control thruster, and hit/miss audio effects; a weight loss and recoil subsystem; a target control subsystem; and a graphics subsystem for visual simulation of smoke, explosion and missile flight.

The gunner's utilization of the weapons system can be monitored from an instructor's console which displays the gunner aiming error graphically, and the gunner sight display via a closed circuit television boresighted to the simulated weapon. The console also provides a keyboard for selecting the training scenario and a means for recording the gunner's performance.

OBJECTS OF THE INVENTION

It is an object of the present invention to provide a cost effective simulator for anti-armor weapons training.

A further object of the invention is to provide a simulator which closely approximates the real-time flight characteristics of the weapon's projectile.

Yet another object of the invention is the simulation of transient effects of weapons firing to simulate the actual use environment.

Still another object of the invention is to record the performance of the operator gunner of the system under simulated live conditions for reiterative training.

Further objects, features, and advantages of the system will become apparent from a study of the description of a preferred embodiment and the accompanying figures.

DESCRIPTION OF A PREFERRED EMBODIMENT

The DRAGON is a command-to-line-of-sight guided missile system. Fired from a recoilless launcher, the missile is tracked optically and guided automatically to the target via electrical impulses transmitted via a wire link. Firing the DRAGON missile is accomplished by depressing the safety and squeezing the trigger. No other action is required of the gunner except to keep the sight cross-hairs on the target. The herein described embodiment simulates the DRAGON weapons system, although it is to be understood that the scope and principles of the invention may be applied to simulate a number of weapons systems.

Figure 1:
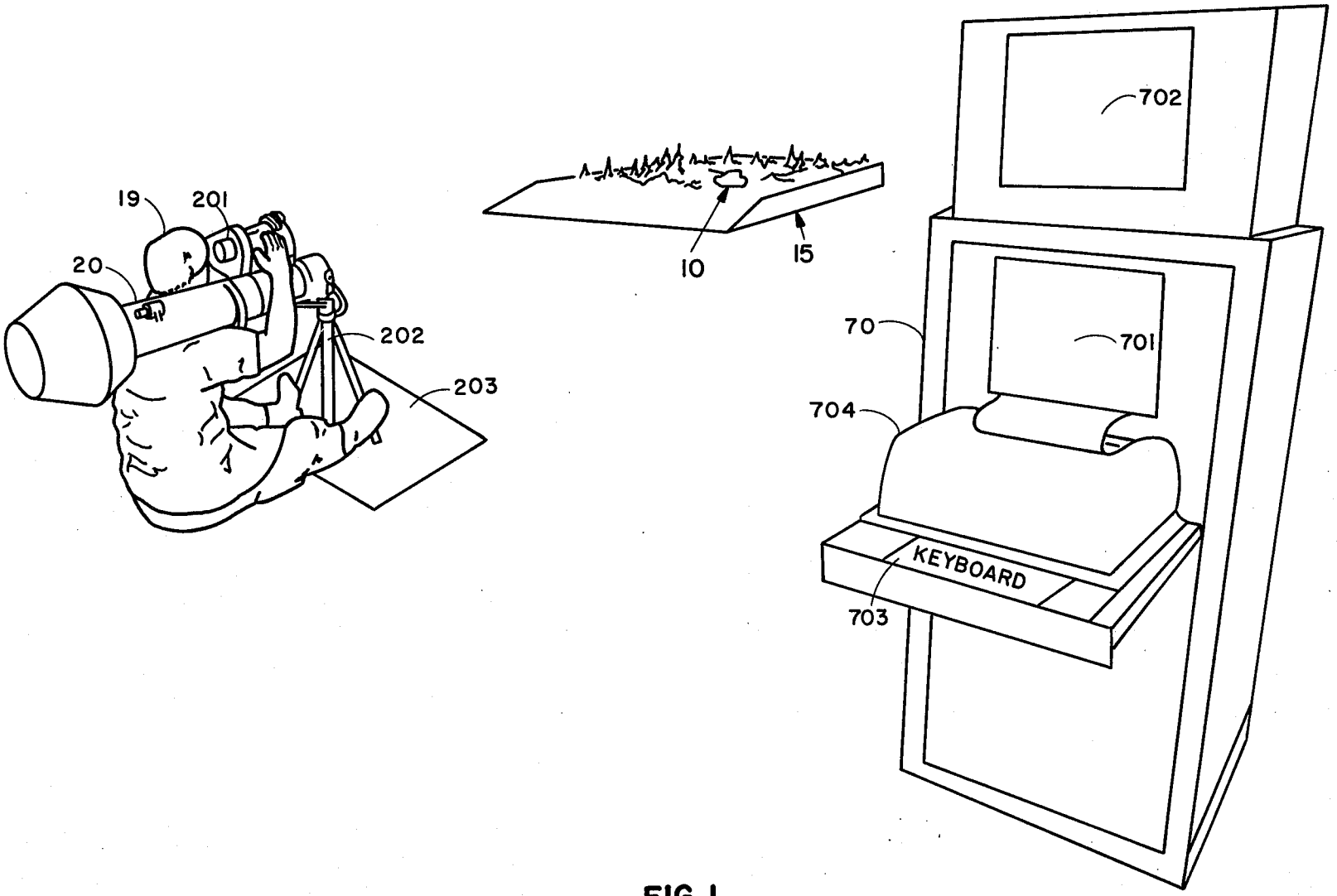
FIG. 1 is a representation of the complete system drawn to scale with respect to the operator.

FIG. 1 is an artist rendition of the present invention in use. An instructor 18 (not shown) may monitor a gunner 19 who is using a simulated weapon 20 to fire at a miniature target 10, which travels on a terrain board 15. Gunner 19 aims weapon 20 through a sight 201. Instructor 18 views target 10 as seen through sight 201 on a gunner's sight picture display 702 mounted in console 70. A real time graphical display of gunner's aiming error is presented in a gunner's aiming error display 701 and recorded by a printer 704.

Figure 2:
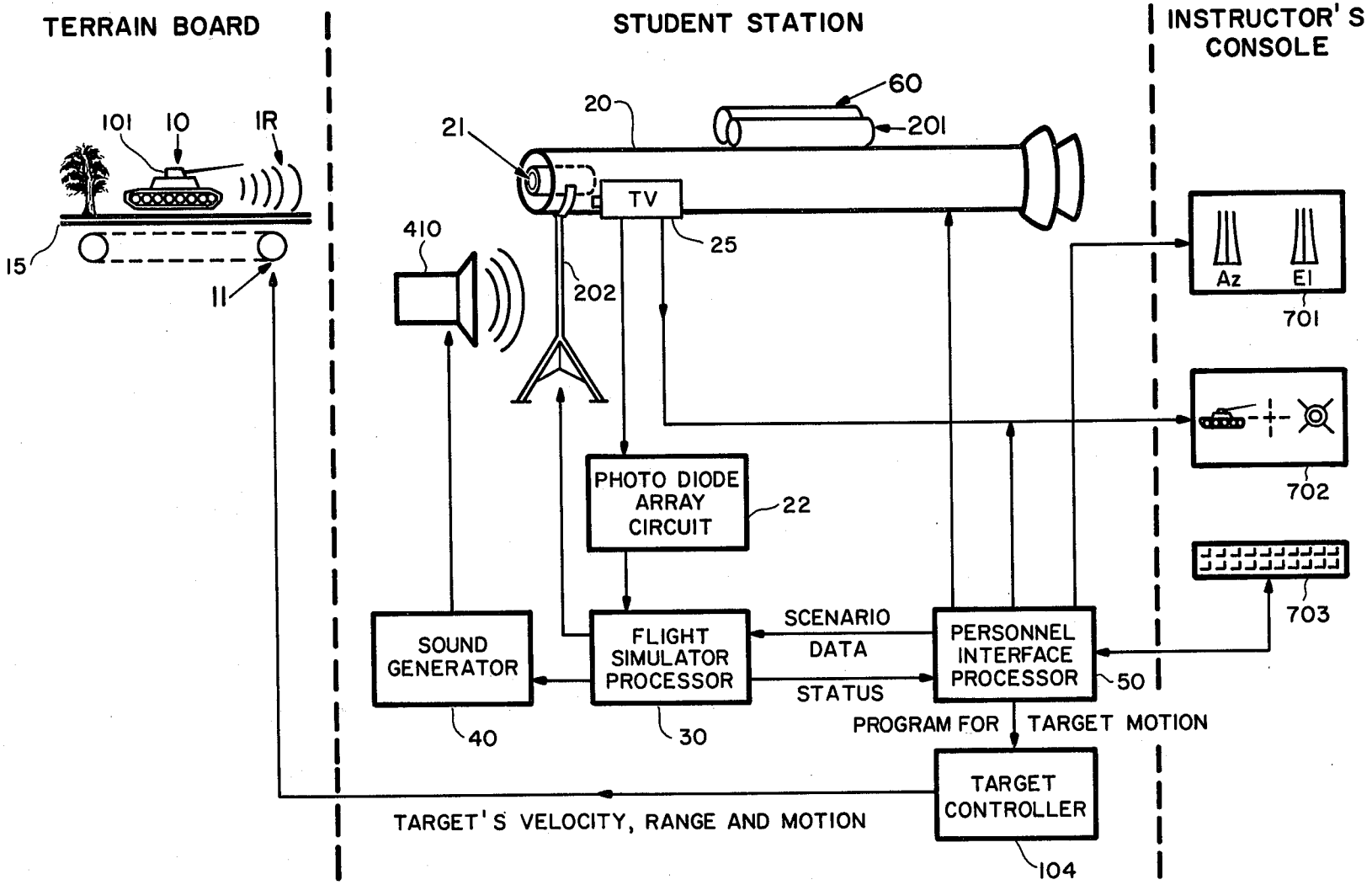
FIG. 2 is a block diagram of the system.

Referring to FIG. 2, target 10 is mounted on terrain board 15 such that stepper motor 11 can move target 10 in a selected engagement scenario under the control of a target controller 104. Target 10 is a 1/120 miniature model of an armored vehicle such as a tank. Model targets were chosen because they have better resolution than either computer generated imagery or a movie display. DRAGON utilizes a 6x sight 201, although other weapons systems use even higher power scopes requiring an even higher resolution scenario.

The engagement scenario is stored in a personnel interface processor 50 and is selected at instructor console 70 via keyboard 703. The scenario program contains target velocity, direction, and range. Scenario data is also provided to a DRAGON flight simulator processor 30 (FSP).

At the center of mass of target 10 is an infrared emitting diode (IRED) 101. Located in simulated weapon 20 is photodiode array camera 21 to sense IRED 101. Camera 21 and a photodiode array circuit 22 interface with FSP 30 in accordance with the teachings of U.S. Pat. No. 4,290,757 to Marshall et al.

FSP 30 uses the data from circuit 22 to determine the gunner's aiming error (GAE). FSP 30 also solves missile flight equations and provides missile status to PIP 50.

PIP 50 controls a graphics unit 60 which inserts simulated missile, smoke, and explosion into gunner's sight 201. PIP 50 also conrols a gunner's aiming error display 701 on instructor console 70, plotting GAE versus time, in real time.

FSP 30 also produces launch and target explosions, thruster rocket firings and gyro noises, using sound generator 40 and speaker system 410.

A closed circuit TV (CCTV) 25 is located on weapon 20 and boresighted to gunner's sight 201. A gunner's sight picture display 702 is located on instructor console 70. The missile and other graphics as seen by the gunner are also mixed into gunner's sight picture display 702.

In order to solve the missile flight equations, several input parameters are required: (a) trigger pull, (b) target position and range, and (c) gunner aiming error. The present invention measures the gunner aiming error with respect to IRED 101 on target 10 using an electro-optic subsystem formed by camera 21 and photodiode array circuit 22. As noted earlier, the function and operation of camera 21 and circuit 22 are detailed in U.S. Pat. No. 4,290,727, the teachings of which are hereby incorporated by reference. For clarity, the developmental model used the following components as an electro-optical subsystem: a lens 211, such as a Nikon zoom lens; a solid state imaging camera 21, such as a Reticon MC520 camera having a 100×100 photodiode matrix array; a controller 221, such as a Reticon RS520 controller; and an interface 222 to FSP 30, such as a Reticon RSB-6020 interface board.

Trigger pull is initiated by the gunner using weapon 20 by pulling a dummy trigger 207 which is electrically sensed and transmitted to FSP 30. Target direction, speed, and range are provided for a given scenario by PIP 50 to FSP 30.

Figure 3:
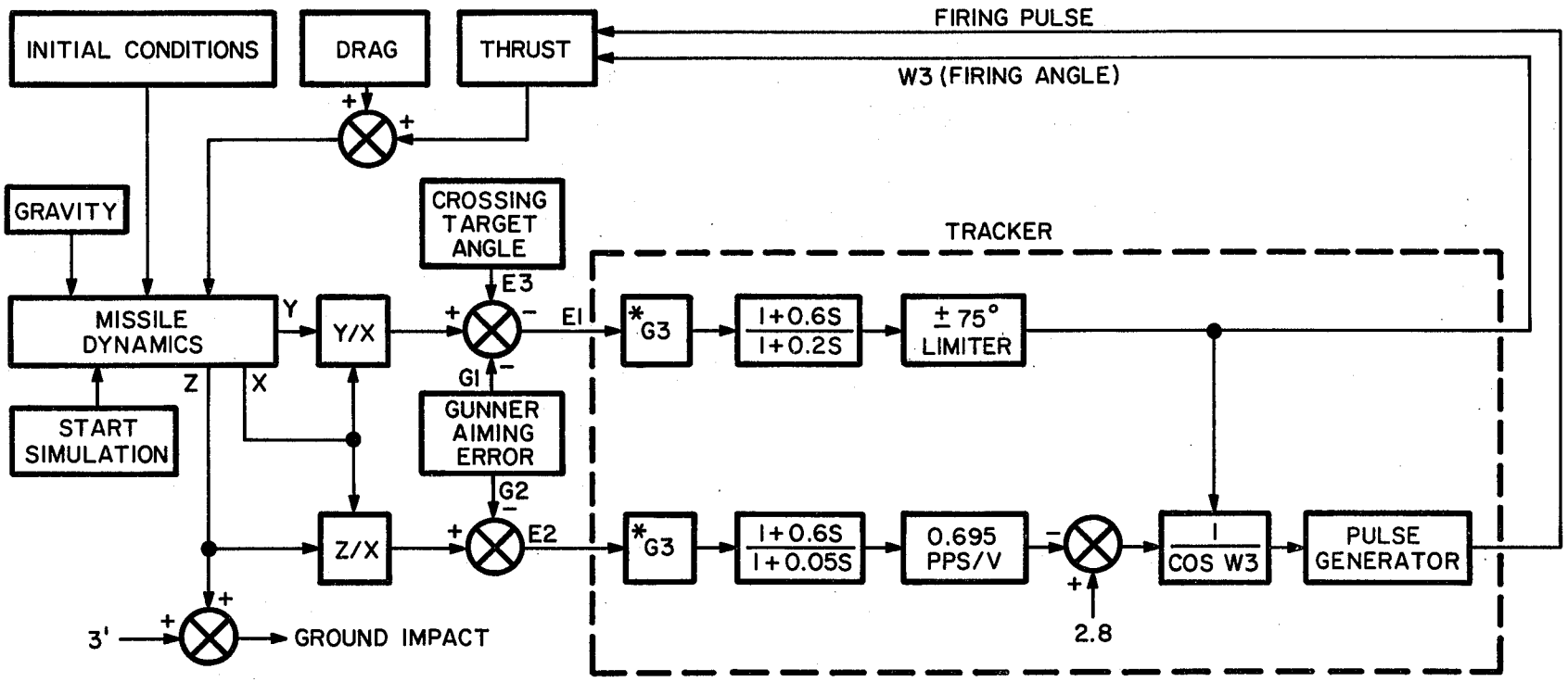
FIG. 3 is a simulation block diagram.

FSP 30 is required to solve three-degree-of-freedom flight equations to express complete missile dynamics. A representative solution process is shown in FIG. 3, wherein angular values correspond to those illustrated in FIG. 4, which represents necessary horizontal plane geometry. Of course, vertical plane geometry must also be input and solved to generate realistic flight equation solutions.

Referring to FIG. 3, at the beginning of each simulated flight, initial missile velocity and position is established in each of three orthogonal axes. The reference axes are established by the initial launch line. Target 10 is placed on the launch line with a selected crossing velocity and time is set to zero. Flight equations are solved every 0.02 seconds in each axis using gravity, drag, and side thruster accelerations as inputs. At the end of each time increment, the new missile position, along with gunner aiming error (G1) and target position (E3) are seen as an angular input (E1) to a tracker unit as represented in the horizontal plane in FIG. 4. Proper thruster firing for simulated guidance of the missile is initiated and the flight equations are iterated. The tracker unit is operational DRAGON circuitry and is not a part of the present invention per se.

The DRAGON flight simulator program actually includes five modules: (1) main DRAGON module, a "driver" module which calls other modules; (2) DRAGON-utility, includes a number of start-up and general procedures; (3) DRAGON flight module, includes the integer math missile dynamics, provides missile location to PIP 50, stores location data for possible reprise, and does the initialization of flight variables; (4) DRAGON IR, analyzes the IR spot data provided by the following module; (5) DRAGON XF, transfers line-by-line data provided by photodiode array interface 222 into a complete picture array. The program is stored in flight simulator processor 30 which can be an Intel SBC 86/12 board. This Intel SBC 86/12 board is also used to control sound generator 40 and photodiode array interface 222.

PIP 50 also can utilize an Intel SBC 86/12 board for its functions. Both PIP 50 and FSP 30 are housed in a system chasis 80 having a multibus 801, power supply 802, and ventilator 803 such as supplied by an Intel SBC 86/12 chasis.

Missile position data resulting from the solution of the missile flight equation are transferred to PIP 50 via multibus 801 for further processing and output. Data status bits are also read and written across multibus 801 as required.

Target controller 104 is a stand-alone intelligent controller that is independent of the host computer, PIP 50, except for loading the scenario. Target controller 104 uses a high level language for control of stepper motor 11 in direction, position, speed and acceleration. Target 10 is moved over a 40-inch track 151 on terrain board 15 which requires 5240 half steps of motor 11. Using this system, target 10 location is known to 0.076 inches on terrain board 15.

A suitable commercially available controller is a Cybernetic Micro System, CY 512, which is a standard 5 volt, 40 pin LSI device configured to control a 4-phase stepper motor. Controller 104 interfaces with PIP 50 using parallel TTL input. Controller 104 also has a software controllable pin which can be used to initiate turret movement when target 10 is a model tank.

Hi-level commands to control the device are stored externally in PIP 50. When a scenario is selected the commands are transferred to and stored in a program buffer in target controller 104. Target controller 104 outputs are used to sequence stepper drive circuits 105 which are standard Darlington drivers.

The position of target 10 is measured by a 16-bit position counter 108, not shown, utilizing four 74191 TTL chips. The counter is reset whenever a new scenario is loaded into target controller 104. Counter 108 then records half-steps of stepper motor 11. When absolute position commands are given, target controller 104 automatically determines whether it is necessary to move clockwise or counterclockwise to reach the specified position.

Figure 5:
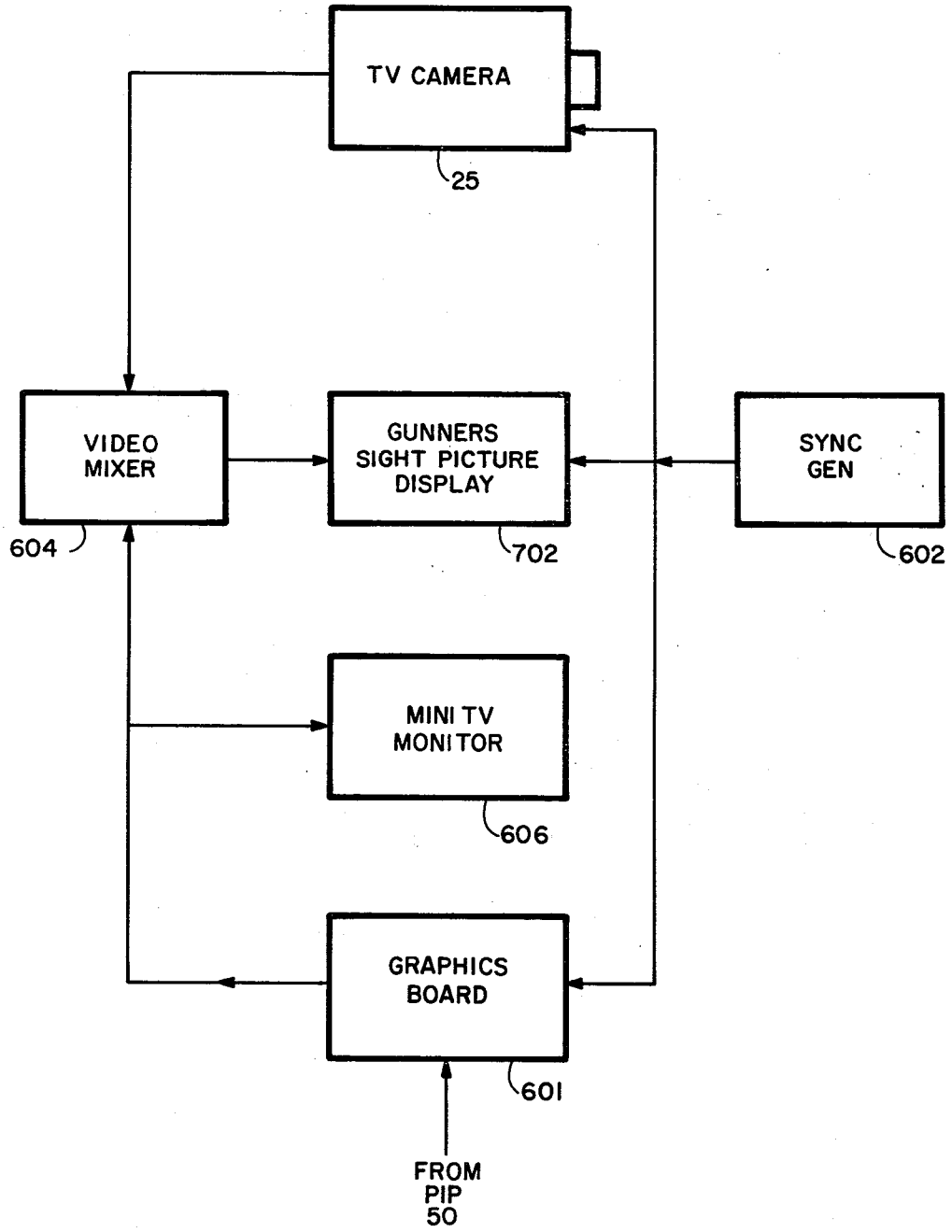
FIG. 5 is a block diagram of the graphics generation circuit.

Referring to FIG. 5, PIP 50 also prepares a computer graphic visual presentation utilizing a computer graphics board 601, an EIA composite sync generator 602, and a phase-locked loop sync board 603 (not shown). Computer generated graphics provide two major functions:

1. Real-time video graphics are generated for insertion in the gunner sight 201, including a simulated missile, thruster firings, smoke obscuration during initial launch, and a final explosion.

2. Real-time graphics are generated for the instructor including both vertical and horizontal aiming errors as well as missile position versus time for follow-up analysis.

Figure 6:
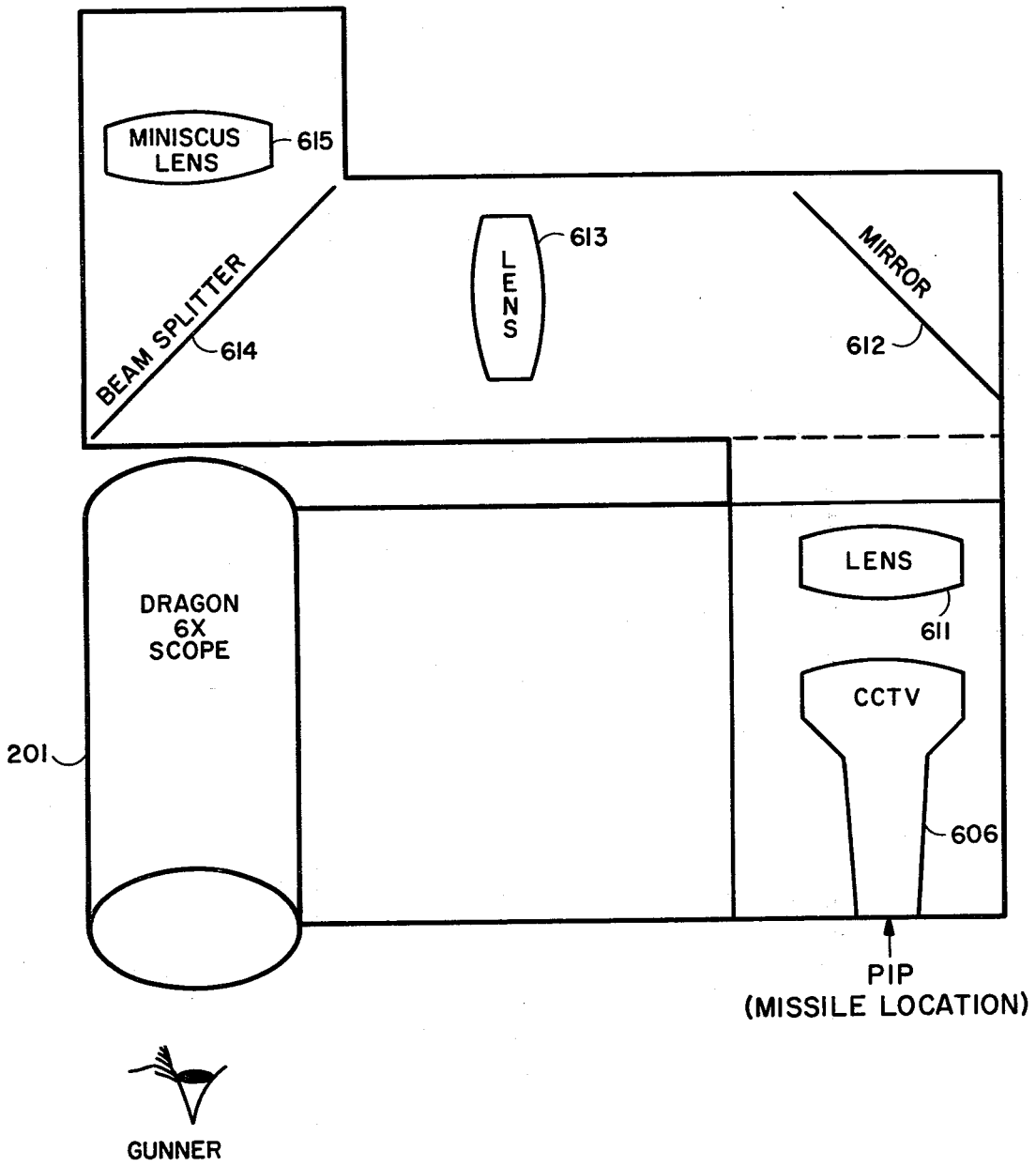
FIG. 6 depicts the optical gunner's sight insertion mechanism.

For gunner's sight 201 insertion, a Matrox RGB-256 graphics board is suitable for computer graphics as it contains built-in NTSC and PAL gray scale encoders which permit graphics board 601 to directly drive standard black and white TV monitors on a single 75 ohm cable. The computer generated graphics are passed to gunner's sight 201 through a one and a quarter inch closed circuit TV monitor 606 such as a Hitachi VM151A. The TV image is inserted into the gunner's sight by an optical system 609 as illustrated in FIG. 6, utilizing an arrangement of lenses, mirrors, and beam splitters.

Figure 4:
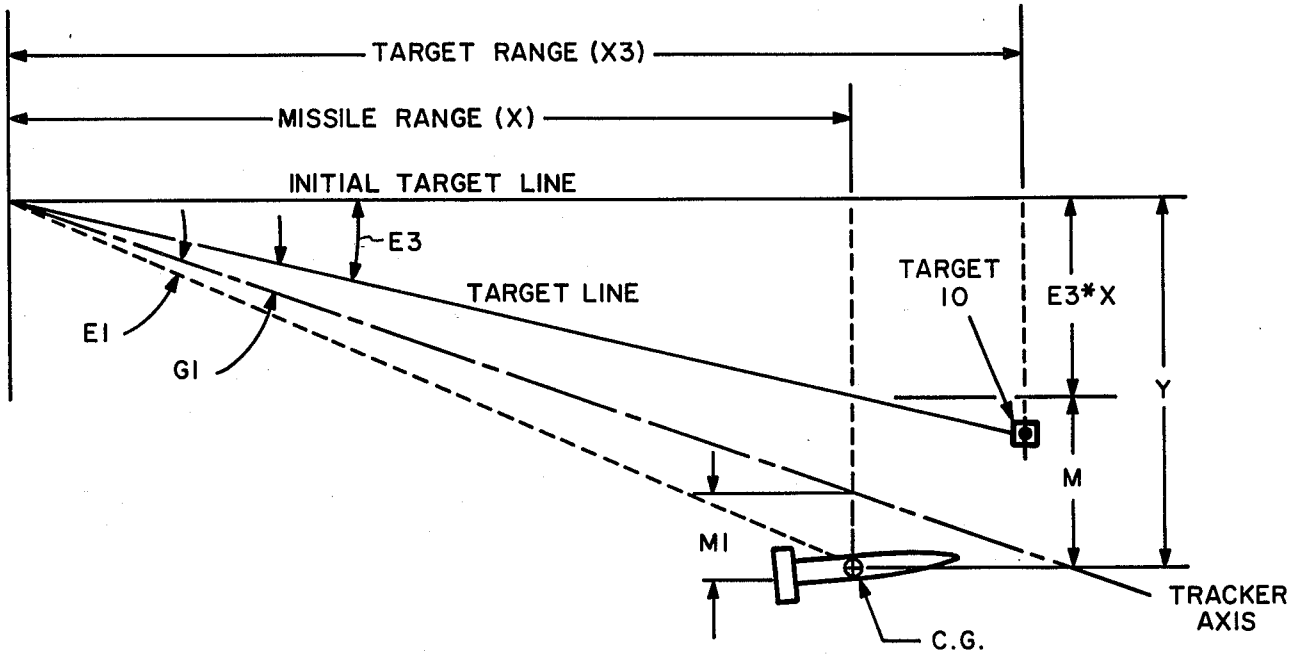
FIG. 4 represents the horizontal plane geometry used to input variable conditions.

PIP 50 uses gunner's aiming error supplied by FSP 30 to position the final explosion graphic in sight 201. Angle E1 from FIG. 4 is used by PIP 50 to position the missile graphic in sight 201.

The instructor's television representation is accomplished by mixing the image from gunner's sight TV camera 25 with the video graphics presented to gunner's sight 201 by graphics board 601. Camera 25 is boresighted and stopped to sight 201. Crosshairs are added via a crosshair generator 711. A suitable commercial model for camera 25 is an RCA TC-2021/N with a Newvicon camera tube and a 135 mm f3.5 still camera lens.

Figure 7:
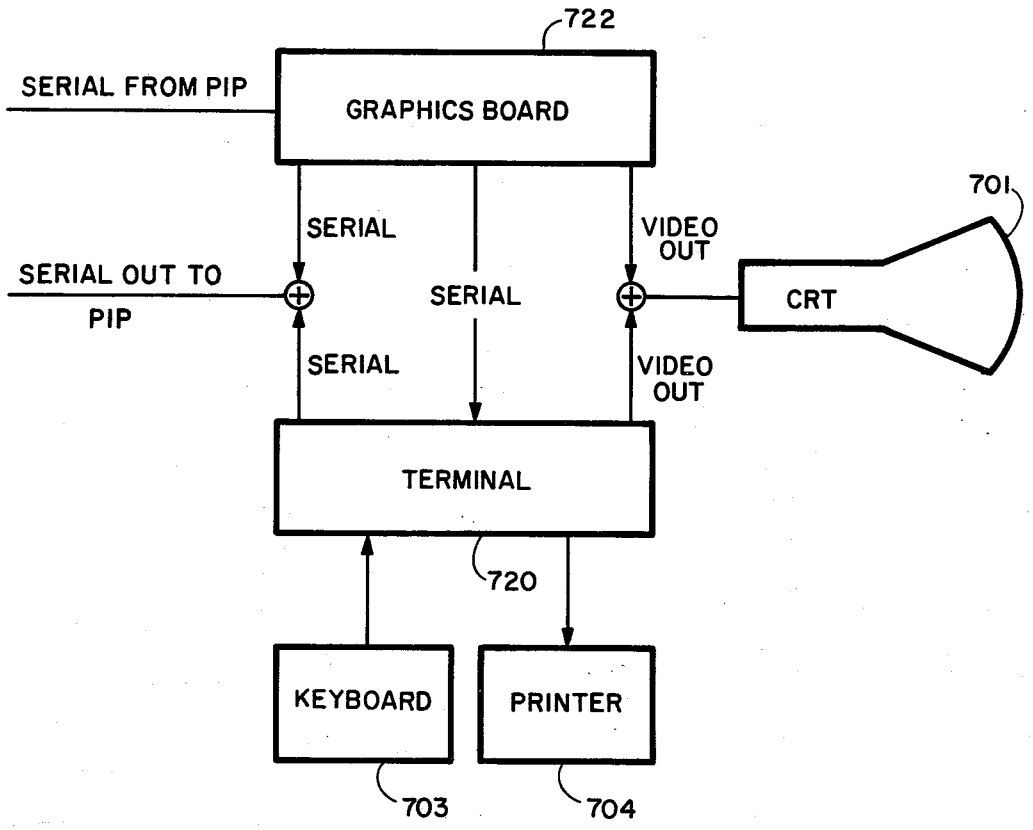
FIG. 7 is a block diagram of the gunner's aiming error display circuit.

Any of the computer graphic plots may be made into a hard-copy printout. The instructor's diagnostic graphs, keyboard controls, and hard copy printouts are controlled by PIP 50 through a dumb terminal 720, a graphics board 722, and a hard copy printer 704, as illustrated in FIG. 7. Suitable commercial devices for these components are: a Lear Siegler ADM-3A dumb terminal; a Digital Engineering Retrographics RB-512 graphic board; and a Digital Engineering GP-100 hard copy printer.

The operation of terminal 720 can best be understood by considering graphics board 722 as the terminal controller and terminal 720 as a peripheral device. Graphics board 722 is situated in series between terminal 720 and PIP 50. This means that all incoming ASCII code will be received by graphics board 722 and processed. Input to terminal 720 will only be via graphics board 722.

FSP 30 controls simulation of sounds produced during an actual missile firing by interfacing a microcomputer 401, such as an Intel 8748, to a pair of programmable sound generators 402, such as a General Instruments AY-3-8910 programmable sound generator. Data required for sound generator 402 to reproduce sounds is acquired from the permanent memory of microcomputer 401, thus FSP 30 needs only to communicate a selection of stored sounds to microcomputer 401 to initiate sound simulation.

The choice of sounds available to FSP 30 are: gyro windup; missile launch explosion; rocket thruster motor firing; target missed explosion; and target hit explosion.

Two sound phenomenon must be simulated for accurate representation: time delay due to the difference in the speeds of light and sound; and logarithmic decay in the amplitude of sound with distance. Software developed for microcomputer 401 closely approximates these conditions within a 1000 meter range.

Figure 8:
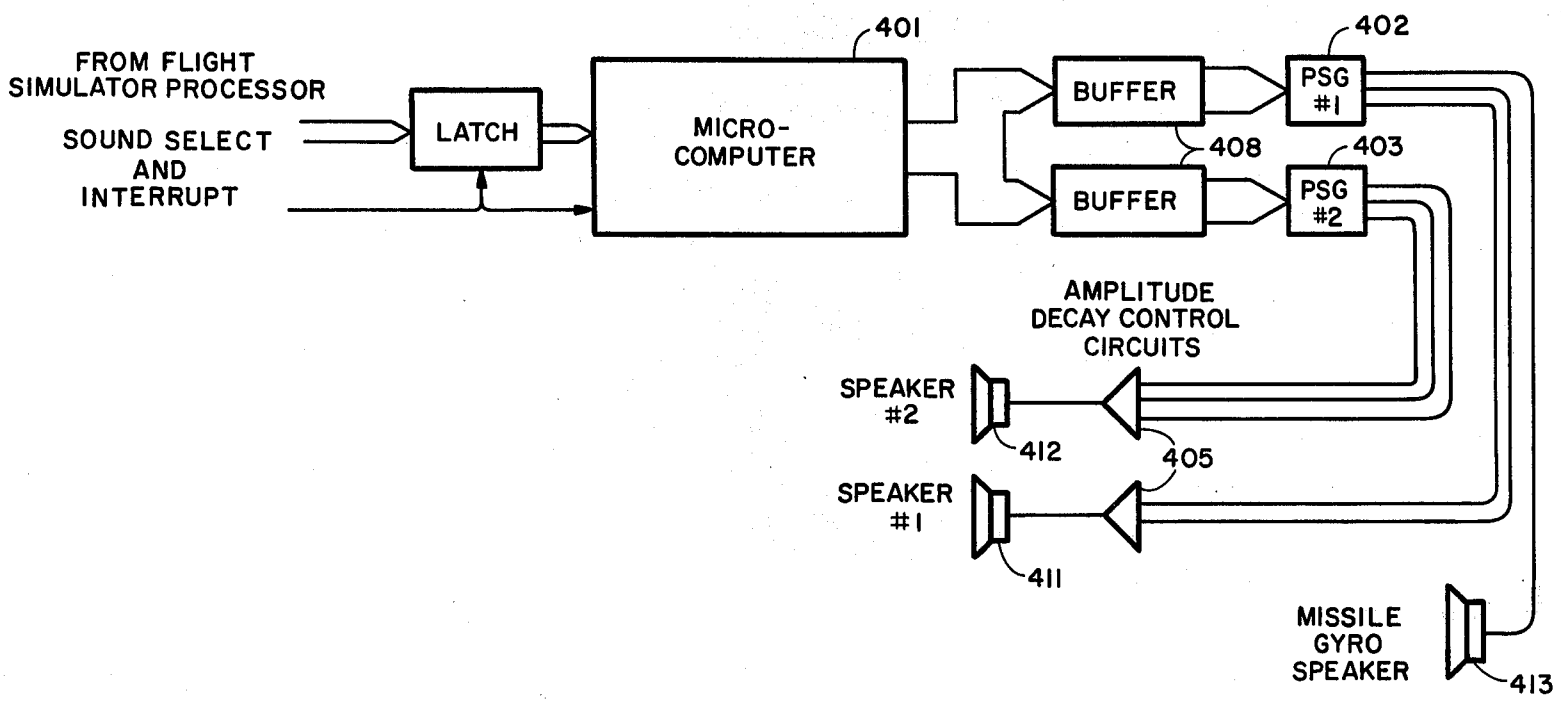
FIG. 8 is a block diagram of the sound generation circuit.

As shown in FIG. 8, the outputs of sound generators 402 and 403 are input to amplitude control circuits 405. Circuits 405 comprise operational amplifiers 407 with closed loop gain circuits under control of microcomputer 401. An input-output port expander 406, such as an Intel 8243 is used to select feedback networks of the operational amplifiers in the thruster firing circuit.

Launch explosions are heard through a first speaker 411 located near the gunner's station; rocket thruster noises are heard through a second speaker 412 located near terrain board 15; and gyro noises are heard from a third speaker 413 located in the base of weapon 20.

Launch effects of the weapons simulator are a very important facet of the training mission. Two of the launch transients which must be overcome by the gunner are the weight loss due to the missile leaving the launch tube, and the recoil of the launcher. These transients are effected by mechanical attachment (not shown) to bipod 202.

The recoil mechanism is a sliding platten 203 upon which bipod 202 and the gunner's feet are supported. At launch, platten 203 is given an impulse from a pneumatic solenoid 204 imparting a sensation of recoil to the launcher.

The weight loss simulation is accomplished by a weight mass 205, attached to bipod 202 via a pivot 206, and pneumatic cylinder 208. Prior to launch, cylinder 208 raises weight 205, thus placing additional weight on the gunner's shoulder via mechanical leverage. On launch, weight 205 is released, thus effectively decreasing the weight at the gunner's shoulder.

Three LED indicators 721, 722, 723 on instructor console 70 provide a quantitative indication of how much force a gunner places on weapon 20 and his shoulder.

Figure 9:
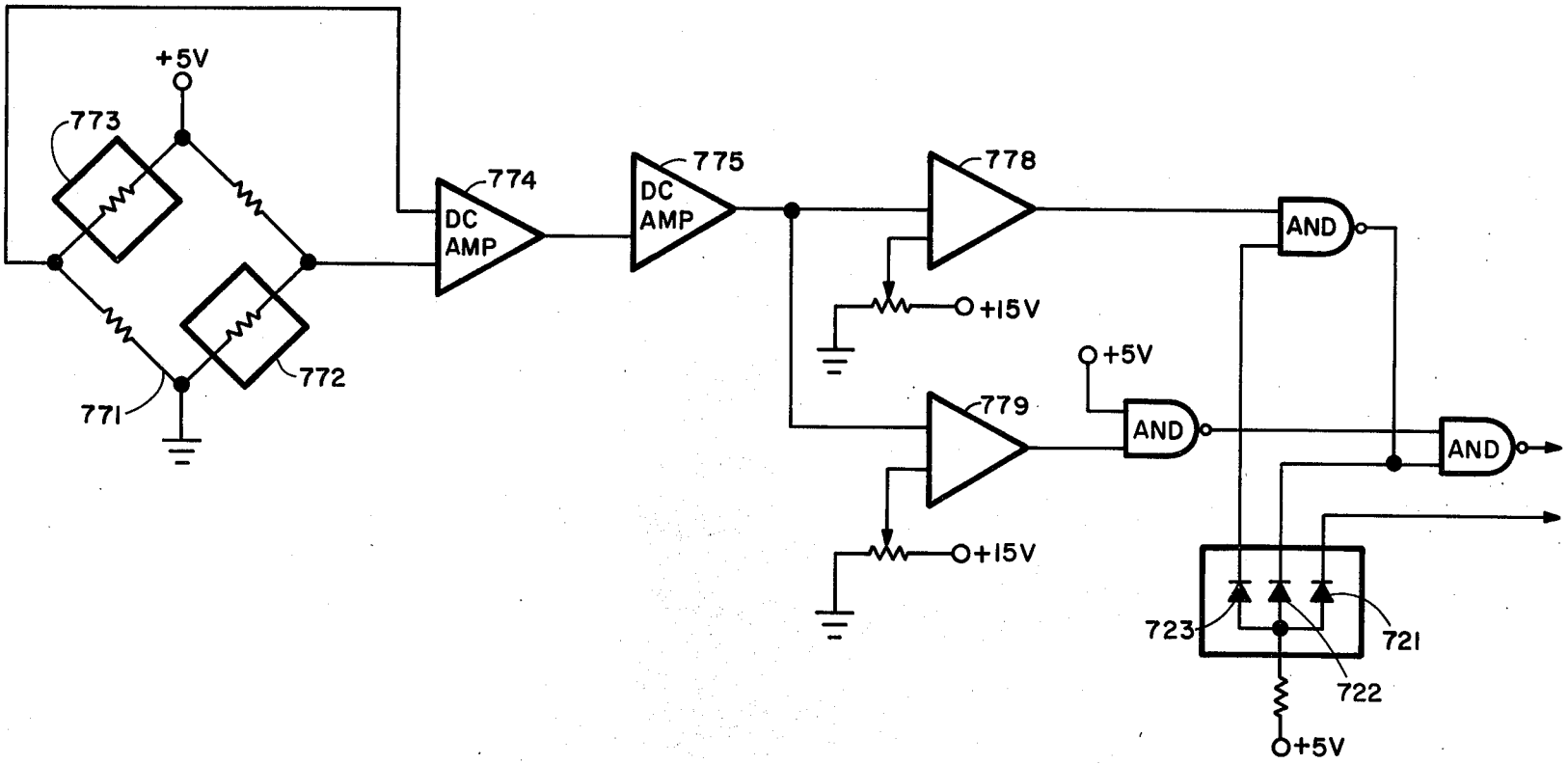
FIG. 9 is a schematic of the pressure measurement circuit.

A circuit as shown in FIG. 9, using a strain gauge bridge 771, was developed to generate a signal which is strictly the result of a force at the trainee's shoulder. The strain gauges used are manufactured by Wm. T. Bean, Inc. Two of the gauges 772 and 773 are strategically located on weapon 20 so as to unbalance bridge 771 only if the gunner has his shoulder properly positioned and is applying a downward force on sight 201. As shown in FIG. 9, bridge 771 supplies a DC level to first and second stage DC amplifiers 774 and 775. The amplified DC level is input to two comparators 778 and 779. Comparator 778 activates the yellow diode 722 when its threshold is breached. The green diode 723 is activated when greater pull-down force is applied, thus generating a higher threshold for comparator 779. Red diode 721 is on if neither threshold is reached.

Figure 10:
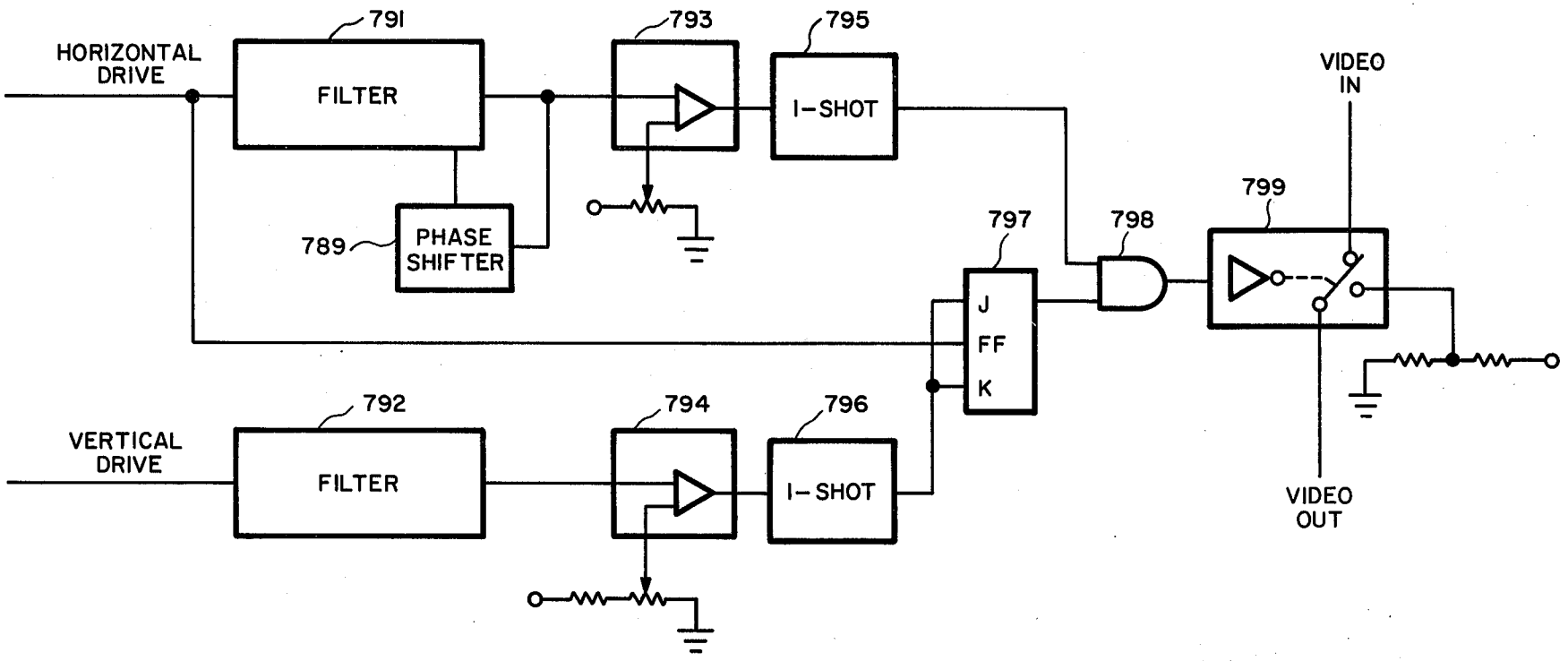
FIG. 10 represents a reticle insertion circuit.

An electric reticle is inserted in instructor's gunner sight display 702 is provide more realism. Referring to FIG. 10, a cohu sync generator 602 located inside console 70 provides drive signals to synchronize all the video signals throughout the system. The vertical and horizontal drive signals provide inputs to the reticle circuit. Each signal passes through a low pass active filter 791 and 792 with a cut-off frequency centered at the repetition rate of the drive signal yielding sine wave outputs of frequency identical to the repetition rate of the inputs. Voltage comparators 793 and 794 receive the filter output and generate TTL square waves with falling edges adjustable about midway between two drive pulses. The falling edges trigger one-shots 795 and 796 which generate pulses whose duration determines the width of the reticle lines.

A horizontal reticle is produced by blanking out one or more lines of video. To insure that an entire line is blanked and not a portion of it, a J.K. flip-flop 797 further conditions the output of horizontal line one-shot 795. Clock for flip-flop 797 is provided by the vertical drive pulse which occurs for each line of video. The output of flip-flop 797 and one-shot 795 input to an AND gate 798 which controls an analog switch 799. Switch 799 allows video to pass to display 702 unless actuated by AND gate 798. The position of the horizontal line is adjusted at voltage comparator 794. Position of the vertical line is controlled by a phase shifter 789 at the input of voltage comparator 793.

In operation, gunner 19 initiates the simulated missile launch by pulling trigger 207. Gyro wind-up noises, launch explosion noise, launch smoke obscuration, recoil and weight loss are sensed by gunner 19 as they are generated under the control of PIP 50 and FSP 30. Gunner 19 must "track" target 10 through sight 201. A simulated missile is visible in the sight; control thruster noises are generated simulating down range sounds.

Instructor 18 can view the target exactly as seen by gunner 19 or he can monitor a graphical display of gunner aiming error in the horizontal and vertical plane as well as thruster firings versus ideal thruster firing.

FSP 30 is continually solving the missile dynamic flight equations, completing 500 iterations thereof for a 10-second flight, and solving for gunner's aiming error which is used to position the simulated missile and eventually determines whether a hit or miss is recorded. Hit or miss audio and visual simulation is inserted into the training scenario and a hard copy record of gunner 19 performance can be made.

It is to be understood that the above described embodiment is presented by way of illustration and is not intended to limit the present invention which may be practiced with numerous modifications and adaptions without departing from the spirit or principles of the invention which are set forth in the appended claims.

What is claimed is:

1. An apparatus for simulating anti-armor training with gunner controlled guided missiles comprising:

means for simulating a moving target in a realistic scenario;

a simulated weapon;

means for sensing a gunner's aiming error with respect to said target;

means for monitoring utilization of said simulated weapon;

means for simulating optical and audio transient effects of utilization of said weapon;

a controllable stepper motor operably connected to drive said target simulating means;

controlling means having a first output to said controllable stepper motor, a second output to said monitoring means, a plurality of outputs to said transient effects simulating means, a first input from said sensing means, an input from said monitoring means, and an input from said simulated weapon, said controlling means having knowledge of said simulated target position and said simulated weapon's flight characteristics, and utilizing said knowledge and said inputs to provide real time simulation of said missile's flight.

2. An apparatus for simulated anti-armor gunnery training comprising:

a miniature terrain board;

a miniature target movably mounted on said terrain board;

an infrared source mounted at the center of mass of said target;

a simulated weapon having a trigger thereon for simulated firing of simulated missiles at said target and a sight for aiming said weapon, said trigger having an electrical output;

means for sensing said infrared source mounted within said weapon and boresighted therewith providing an output based on the sensed position of said infrared source;

an instructor console for monitoring the utilization of said simulated weapon, having a display for indicating gunner aiming error, a picture display simulating the view through said weapon sight, and a means for inputting commands to said apparatus;

a TV camera mounted and boresighted on said weapon to view said terrain board, inputting a picture of said target into said instructor console display;

means for controlling the motion of said target including a four-phase stepper motor operably attached to said target;

a sound generating means for outputting sounds simulating the firing of said weapon;

a flight simulator processor for solving the dynamic flight equations for said simulated missiles based on predetermined physical constraints and parameters as well as inputs from said terrain board and said IR sensing means, said processor additionally determining the gunner's aiming error from said IR sensing means input, having a first input from said sensing means, a second input from said weapon trigger, a first output to said sound generating means for control thereof, a second output for outputting simulated missile flight parameters, and a third input for receiving scenario information corresponding to the location of said target on said terrain board;

means for inserting flight characteristic graphics into said sight and said instructor console picture display operably connected thereto;

a personal interface processor, for actuating said insertion means and interfacing apparatus components having a first input from said flight simulator processor, a second input from said instructor console command input means, a first output to said means for inserting graphics, a second output to said traget controlling means, a third output to said instructor console gunner's aim error display, and a fourth output providing scenario data to said flight simulator processor.

3. An apparatus according to claim 2, wherein said target controlling means comprises:

said four phase stepper motor operably attached to said target;

a target controller, for controlling said stepper motor in accordance with a particular engagement scenario provided from said personnel interface processor, the output of said target controller sequencing said stepper motor;

driver circuits connected between said stepper motor and said target controller;

an interface circuit for communicating a programmed scenario from said personnel interface processor to said target controller operably connected therebetween; and a position counter connected to said target controller for determining the exact location of said target by determining the number of half-steps said stepper motor has taken.

4. The apparatus of claim 3, wherein said simulated weapon is a shoulder borne tubular rocket launcher having a forward weight bearing member for stability.

5. The apparatus of claim 3, wherein said simulated weapon is a tripod mounted tubular rocket launcher.

6. An apparatus according to claim 3, wherein said sensing means further comprises:

a solid state imaging camera, having a photodiode matrix as a sensor of said IRED source, outputting a matrix display of light transitions;

interface electronics for transmitting said camera's output to said flight simulator processor, operably connected therebetween;

a controller for synchronizing said interface electronics and said camera operably connected thereto; and a lens attached to said camera, set at a predetermined field of view.

7. An apparatus according to claim 6, wherein said sound generating means comprises:

a microcomputer having a permanent memory containing data required for generating sounds associated with weapons firing, said microcomputer having an access connection to said flight simulator processor for selection of desired sounds;

a programmable sound generator, receiving data from said microcomputer and having an output based thereon;

an amplitude control circuit, receiving input from said sound generator, for simulating effects of distal sounds associated with weapons firing comprising:

an input-output port expander under the control of said microcomputer for selecting feedback networks for said circuit, a plurality of operational amplifiers receiving input signals from said programmable sound generator, and having closed loop gain circuits under the control of said microcomputer;

a first speaker for outputting launch explosion sounds generated by said programmable sound generator operably connected to said amplifier control circuit and positioned near said simulated weapon;

a second speaker for outputting rocket thruster sounds and hit/miss explosions generated by said programmable sound generator, operably connected to said amplitude control circuit and located near said terrain board; and a third speaker outputting gyro noises output by said programmable sound generator operably connected thereto and located within said simulated weapon.

8. An apparatus according to claim 7, wherein said graphics insertion means comprises:

a computer graphics circuit board receiving input from said personnel interface processor, and outputting a video display in accordance therewith to simulate smoke, missile position, and explosions;

a mini TV monitor for video insertion in said gunner's sight receiving input from said graphics board;

a video mixer for combining said TV camera's image of said target with the output of said computer graphics board, outputting a combined image signal thereof;

an electronic crosshair generator for applying adjustable crosshairs to said image receiving the output of said video mixer as an input and outputting an image signal having crosshairs thereon to said instructor console picture display; and an optical system for reflecting the image from said mini TV monitor into said gunner's sight comprising:

a first focusing means for transmitting and focusing said image, a mirror downstream of said first focusing means reflecting said image 90°, a second focusing means downstream from said mirror and transmitting the reflected image therefrom, and a beam splitter for combining said image from said mini TV monitor with the image from said terrain board reflecting said TV image into said gunner's sight and transmitting said terrain board image thereinto.

9. An apparatus according to claim 8, further comprising:

a system chassis for housing said flight simulation processor and said personnel interface processor having a power supply and ventilation means for servicing said processors and a multibus for interconnecting said processors and the remainder of the apparatus, said multibus providing a means for communicating electrical signals from said processors to each other.

10. An apparatus according to claim 9, wherein said personnel interface computer is programmed to generate graphical data for presentation on said instructor's console gunner's aiming error display, said display being operably connected to receive and display said data, said personnel interface processor receiving its gunner's aiming error data from said flight simulation processor.

11. An apparatus according to claim 10, wherein said instructor's gunner aiming error display comprises:

a computer terminal, having a keyboard for operator input and a CRT monitor for display thereon, receiving serial data input to control said display, and outputting serial data to said personnel interface processor; and a graphics unit serving as a controller for said computer terminal outputting serial data thereto, receiving serial data from said personnel interface processor, having a video output connected directly to said computer terminal CRT monitor, and having a serial output connected to said personnel interface processor.

12. An apparatus according to claim 11, wherein said recording means comprises a printer operably connected to receive data from said computer terminal and outputting printed copies of said CRT display.

13. An apparatus according to claim 12, further comprising a pull-down force sensing circuit comprised of:

a strain gauge bridge for sensing the force exerted by the gunner on said simulated weapon, operably attached to said weapon to sense said force and outputting a DC level proportionate thereto;

means for amplifying said DC level receiving input from said strain gauge bridge;

a first voltage comparator receiving input from said amplifying means and a predetermined threshold input, outputting a logic pulse when said threshold is breached;

a tristate light emitting diode;

a first AND gate having input from said first voltage comparator and from said tristate LED connected so as to activate one state of said LED;

a second voltage comparator operably connected to said amplifying means having a threshold input higher than said first voltage comparator, outputting a logic pulse when said threshold is breached; and a second AND gate receiving input from said second voltage comparator and said tristate LED configured so as to activate a second state of said LED.

* * * * *